United States Patent [19]

Schlegel et al.

[11] Patent Number: 4,864,935

[45] Date of Patent: Sep. 12, 1989

[54] SMALL-ARM AMMUNITION IN SHOT FORM

[75] Inventors: Kurt Schlegel, Zurich, Switzerland; C. Friedemann Betz, Edertal/Giflitz, Fed. Rep. of Germany

[73] Assignee: Obisco Trading & Consulting S.A., Switzerland

[21] Appl. No.: 140,689

[22] Filed: Jan. 4, 1988

Related U.S. Application Data

[62] Division of Ser. No. 835,226, Mar. 3, 1986, abandoned.

[30] Foreign Application Priority Data

Feb. 14, 1986 [EP] European Pat. Off. ..... 86101.927.1
Mar. 5, 1986 [DE] Fed. Rep. of Germany ..... P 3507758.1

[51] Int. Cl.[4] ..... F42B 7/04

[52] U.S. Cl. ..... 102/438; 102/457; 102/472

[58] Field of Search ..... 102/430, 438, 443, 448, 102/449, 455, 457, 469, 470, 472

[56] References Cited

U.S. PATENT DOCUMENTS 949,063 2/1910 Dorn ..... 102/438
3,844,217 10/1974 Ziemba ..... 102/276
4,619,202 10/1986 Romer et al. ..... 102/443

FOREIGN PATENT DOCUMENTS 0193766 9/1986 European Pat. Off. .
244395 10/1909 Fed. Rep. of Germany .
326639 7/1919 Fed. Rep. of Germany .
3309147 9/1984 Fed. Rep. of Germany .
3325755 1/1985 Fed. Rep. of Germany .

OTHER PUBLICATIONS

European Search Report No. 86101927.

*Primary Examiner*—Stephen C. Bentley
*Attorney, Agent, or Firm*—Wegner & Bretschneider

[57] ABSTRACT

The present invention is directed to small-arm shot ammunition having a propelling charge and an explosive charge. Separate igniters are provided for each of the charges. An ignition means is coupled to a trigger unit for operating the propelling charge igniter and the explosive charge igniter with different time intervals. The intervals are automatically selected as a function of range between the small-arm and the target. In this way, the disintegration of the ammunition ocurs as close to the target as possible.

10 Claims, 3 Drawing Sheets

Figure 1:
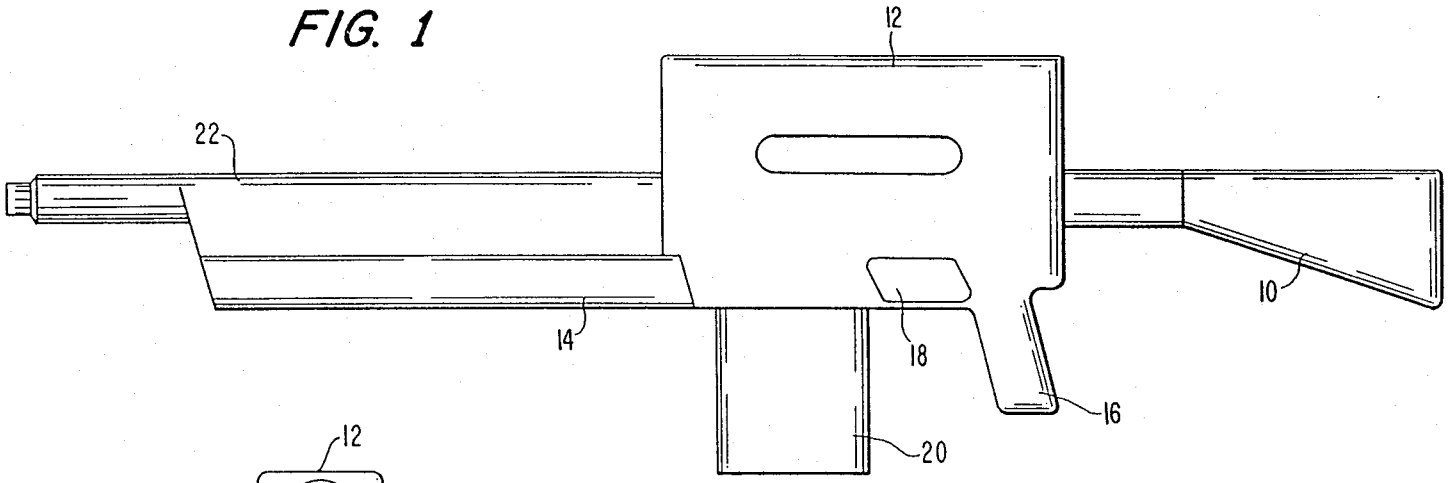

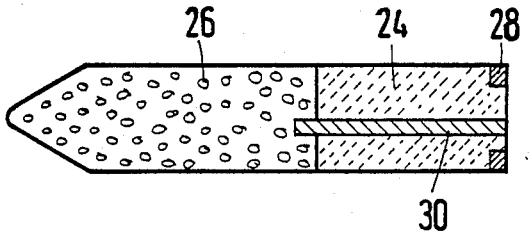
Fig. 2
Fig. 3
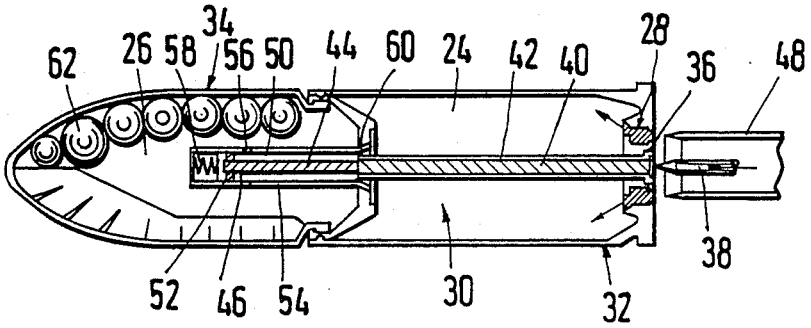

SMALL-ARM AMMUNITION IN SHOT FORM

This is a divisional application of U.S. application Ser. No. 835,226, filed Mar. 3, 1986, now abandoned.

The present invention relates to a small-arm for firing ammunition in shot form having a propelling charge and an explosive charge ignitable after a time interval with a disintegration point close to the target, having separate igniters for the propelling and explosive charges. An ignition means and a control unit are coupled to a trigger unit for operating the propelling charge igniter and the explosive charge igniter with different time intervals. The invention also relates to shot ammunition for use in such a small-arm having a propelling charge equipped with a propelling charge igniter and an explosive charge provided with an explosive charge igniter spatially and actionwise separated therefrom.

Shot ammunition has a number of advantages over solid or ball ammunition, in particular, shot ammunition exhibits a larger action range than solid projectile ammunition. A disadvantage of using shot ammunition, both for hunting and infantry purposes is that it is only effective over a relatively short range due to the start of disintegration of the projectile into the individual shot pellets or the like immediately after leaving the small-arm barrel. Attempts have been made to counteract this disintegration by using shot ammunition which only completely disintegrates a relatively long time after leaving the small-arm barrel. However, this solution does not permit an optimum adaptation of the disintegration point of the projectile to the attacked target.

German Pat. No. 2 44 395 discloses a small-arm for using shot ammunition of the aforementioned type in which simultaneous or successive ignition of the propelling and explosive charges is possible through actuation of one of two different triggers. Thus, either a close-range or long-range scattered shot can be obtained. If a long-range scattered shot is chosen, the propelling charge is ignited and, in turn, detonates the explosive charge by means of the corresponding explosive charge igniter. This arrangement does not permit the disintegration of the ammunition at a point close to the target as a function of the particular sighted target. There are also only fixed set ignition possibilities in the case of the selection bullet of German Pat. No. 3 26 639, and, as a result, disintegration of the ammunition in a selectable zone close to the target is not possible. DE-AS Nos. 12 10 360 and 12 58 766 describe laser target optics for anti-tank guns which ensure an exact target acquisition, but do not solve the problem of the disintegration of small-arm ammunition close to the target.

Thus, the problem of the present invention is to further develop the small-arm and ammunition in shot form, so that attack of remote targets is possible while retaining the ballistic characteristics of solid projectiles and the advantageous effects inherent in shot ammunition. The latter term is generally understood to mean ammunition disintegratable through the action of separate explosive charge after leaving the small-arm barrel.

According to the invention, this problem is solved in a small-arm having target optics provided with a laser range finder for automatically determining the range with respect to a target sighted by the target optics and an ignition means and an electronic control unit for the variable time-delayed ignition of the propelling charge as a function of the measured range values supplied to it by the laser range finder. The propelling charge is spaced from the explosive charge which detonates with a fixed time lag following ignition. An electrical supply unit provides the energy supply of the electrical or electronic components.

The range values determined by the laser range finder can be reflected into the target optics.

The small-arm, according to the invention, can also include a device for automatically determining the elevation/depression and for supplying the corresponding values to the target optics and electronic control unit.

It is also optionally proposed that the electronic control unit be supplied with characteristic code values for the ballistic characteristics of the shot ammunition used, such as mass and the like.

According to the invention, the trigger unit can optionally also have two stages. In the first stage, the electrical or electronic components are activated without the operation of the electronic release means operable by the electronic control unit, thereby allowing the release time for the propelling charge fixed by the electronic control unit to be continuously adapted to the instantaneous range values supplied by the laser range finder. In the second stage, the last range values supplied in the first stage are retained until the operation of the release means.

The invention also optionally provides that, in the first stage of trigger unit operation, the range indication is reflected into the target optics in flashing/variable manner, and, in the second stage, the range indication is reflected thereinto in fixed manner.

A further embodiment of the invention proposes that the remaining number of shots can be automatically reflected into the target optics.

It is also provided that the electrical supply unit may optionally be integrated into the stock and the electronic control unit may optionally be integrated into a handle of the weapon.

The invention also optionally provides for an electrical supply unit having a generator means for converting at least part of the mechanical energy applied during the operation of the trigger unit into electrical energy. The generator means is constructed for supplying adequate electrical energy for the function of the ignition means during the operation of the trigger unit.

According to a further embodiment of the invention the generator means is capable of generating all the electrical energy required for the operation of the electrical or electronic components. The generator means can be constructed for inductive generation of electrical energy.

According to the invention, the generator means can also be constructed for the piezoelectric generation of electrical energy.

Another embodiment of the invention is characterized in that the electrical supply unit has a storage means for collecting the energy released during the intermittent operation of the trigger unit. The storage means can have a mechanical gyrating mass. According to the invention, the storage means can have an electrical accumulator or the like.

The shot ammunition proposed according to the invention for use in a small-arm of the inventive type is characterized in that the detonation of the explosive charge occurs after a fixed time lag from the time of operating the explosive charge igniter.

The fixed time lag between the detonation time of the explosive charge igniter and the operation thereof corresponds to a firing range of approximately 500 m. The propelling charge igniter and/or explosive charge igniter can be electrically or electronically operable.

The invention also optionally proposes that the propelling charge igniter and/or explosive charge igniter are mechanically operable.

The invention also optionally provides that the propelling charge igniter is constructed as a ring igniter and the explosive charge igniter as a central igniter.

The invention also optionally proposes that the explosive charge igniter is positioned laterally with respect to the explosive charge.

According to another embodiment of the invention the explosive charge is only detonated after burning off the propelling charge.

The explosive charge igniter can have a primer or the like, a fast-burning primer composition, a delayed action composition and an explosive primer composition wherein the explosive primer composition detonates the explosive charge.

According to another embodiment of the invention the delayed action composition is ignitable by the propelling charge in the event of a failure of the primer and/or the fast-burning primer composition.

It can in particular be provided that the delayed action composition and the explosive primer composition are placed in a fuse positioned in a projectile head containing the explosive charge with the fuse being positioned parallel to the longitudinal axis of the projectile. The fuse or the like is positioned in longitudinally displaceable manner within an ignition sleeve surrounded by the explosive charge and one end thereof is pressed by a spring or the like so as to engage the propelling charge cartridge. The fuse in the vicinity of the explosive primer composition and the ignition sleeve have at least one bore, which are displaced with respect to one another when a connection exists between the projectile head and the propelling charge cartridge and can be brought into alignment with one another on detaching the projectile head from the propelling charge cartridge through the longitudinal displacement of the fuse in the ignition sleeve under the action of the spring.

According to the invention, preferably the ignition sleeve and the fuse are terminated by a base at their end remote from the propelling charge cartridge and that the spring is a compression spring supported between the fuse base and the ignition sleeve base.

It is also possible to proceed in such a way that the fastburning primer composition extends concentrically to the projectile axis substantially from the primer to a contact surface of the propelling charge cartridge facing the projectile head. The fast burning primer composition is positioned within a protective ignition sleeve, which is substantially completely surrounded by the propelling charge and that the ignition sleeve is also concentric to the projectile axis.

Finally, according to the invention, the fuse and/or ignition sleeve is provided at its end facing the propelling charge cartridge with a widened portion for subjecting the delayed action composition to the action of the propelling charge gases.

Due to the fact that the explosive charge is separate from the propelling charge and is only released close to the target, it is possible to attack in an optimum manner remote targets by means of shot ammunition or the like with a large action range whilst retaining the ballistic characteristics of solid projectiles. As a result of the design of the ammunition with an explosive charge having a fixed ignition time lag with respect to the operation of the explosive charge igniter in conjunction with time-variable delay of the operation of the propelling charge igniter as a function of the measured range values, there is no need for a complicated adaptation of the actual ammunition to the particular range to be attacked. Instead all the relevant matching or adapting work is transferred into the electronic control unit of the weapon, so that the ammunition is inexpensive to manufacture and has a simple construction.

Further features and advantages of the invention can be gathered from the following description of an embodiment relative to the drawings, wherein show:

FIG. 1. an embodiment of a small-arm according to the invention in side view.

Figure 1A:
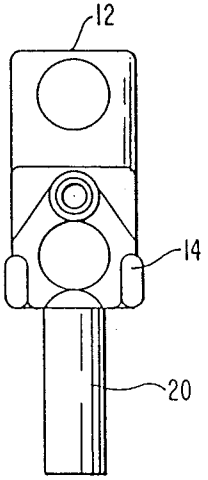

FIG. 1A. an embodiment of a small-arm according to the invention in a front view.

FIG. 2. a diagrammatic section through the longitudinal axis of an embodiment of the shot ammunition usable in the small-arm according to FIG. 1.

FIG. 3. a diagrammatic section through the longitudinal axis of another embodiment of the shot ammunition usable in the small-arm according to FIG. 1.

Figure 4:
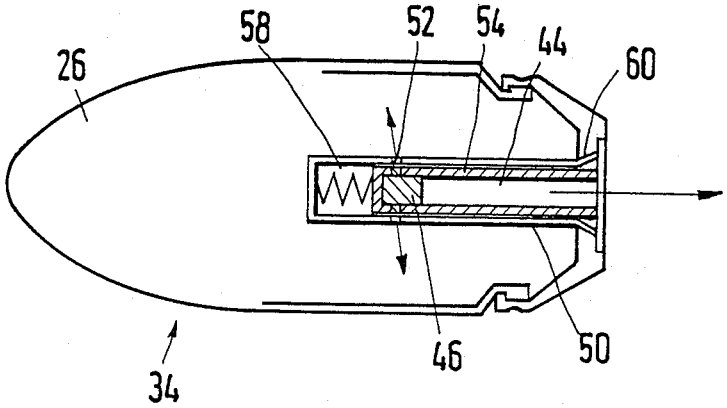

FIG. 4. the projectile head of the shot ammunition of FIG. 3 after leaving the barrel on igniting the explosive charge.

Figure 5:
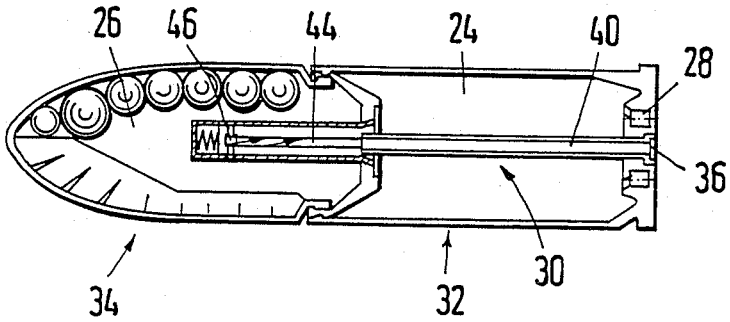

FIG. 5. the shot ammunition according to FIGS. 3 and 4 in an operating state when the explosive charge igniter does not function following the failure of the propelling charge.

Figure 6:
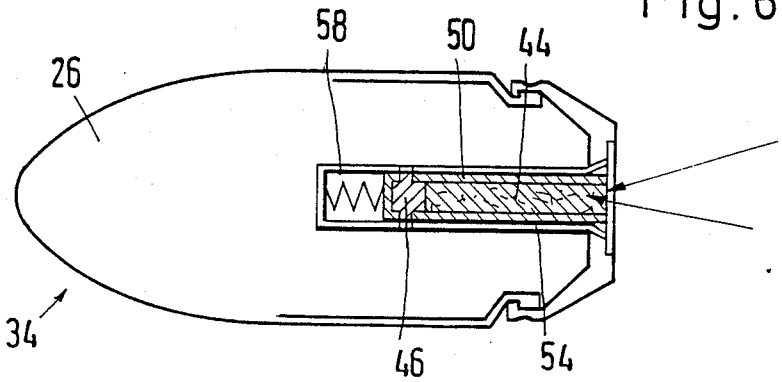

FIG. 6. the projectile head of the shot ammunition of FIGS. 3 to 5 in an operating state in which after the primer or the fast-burning primer composition of the explosive charge igniter has failed, the delayed action composition of the explosive charge igniter is ignited by the propelling charge.

In the represented embodiment, the small-arm of the present invention is a gun with a total length of 1120 mm, a weight of 5.8 kg and a caliber of 19.4 mm. As shown in FIG. 1, the small-arm has a stock with an electrical supply unit in the form of a battery 10 housed therein. Battery 10 supplies the necessary electrical energy for a target optics 12 and a laser range finder 14, whose automatically determined range values with respect to the target sighted by the target optics 12 are reflected into the target optics. The electrical or electronic components include ignition means supplied by battery 10 and also include an electronic control unit 16 which operates with a minimum transient time. Both the range values determined by the laser range finder 14 and the data measured by a device for the automatic determination of the elevation/depression can be supplied to the electronic control unit 16.

The control unit then acts on ignition means, which in turn acts on a two-stage trigger unit 18 for operating the release mechanism for shot ammunition held ready in a magazine 20 and fired from a barrel 22. The shot ammunition in magazine 20 is preferably coded with the code values indicating the ballistic characteristics. Such code values are automatically suppliable to the electronic control unit 16.

FIG. 2 shows an embodiment of the shot ammunition in magazine 20. As can be seen the ammunition is provided in a spatially and actionwise separated manner with a propelling charge 24 and an explosive charge 26, the latter being combined with shot pellets or the like. A propelling charge igniter 28 in the form of a ring igniter is associated with propelling charge 24, whilst the explosive charge 26 is ignitable by means of a explosive charge igniter 30. The latter is constructed in such a way that, following its actuation, the explosive charge 26 is detonated with a fixed time lag, which in the represented embodiment corresponds to a firing range of 500 m. Upon actuating the propelling charge igniter 28, the propelling charge 24 is detonated with substantially no time lag.

In the represented embodiment, the laser range finder 14 functions in increments of 20 cm. In a first stage or on a first path, the trigger unit 18 is supplied with electrical energy from the electrical or electronic components of the system by battery 10. The marksmen sighting the target by means of the target optics 12 recognizes, reflected into the target optics (designed in the form of a residual light amplifier in the represented embodiment in this "activation state" of the trigger unit 18), the firing range in meters instantaneously given by the laser range finder 14. This sight line optically varies its position as a function of the code values of the shot ammunition in magazine 20 and the measured elevation/depression. The remaining number of shots and the sight line is reflected into the target optics. Reflection into the target optics takes place in a flashing/variable manner, with the exception of the sight line. After fixing the target, the marksman brings the trigger unit 18 into the second stage by further pulling on the trigger. Now, the information reflected into optics 12 is fixed. That is, the firing range now remains fixed, so that on sighting another target the firing values supplied to the electronic control unit 16 remain unchanged. If the trigger unit 18 is now pulled up to the release point, the electronic release mechanism actuated by the electronic control unit 16 immediately operates the explosive charge igniter 30 and the propelling charge igniter 28 with a variable time lag fixed as a function of the firing range, ballistic ammunition values and elevation. If, in the represented embodiment, the propelling time igniter 28 and explosive charge igniter 30 are operated simultaneously, the explosive charge explodes at a range of 500 m. If the firing range is shorter, then the ignition of the propelling charge igniter 28 takes place at a corresponding time following the ignition of the explosive charge igniter 30.

The small-arm and ammunition system according to the invention has the advantage that the explosive charge only explodes at the objective or target with great accuracy, increments of 20 cm being obtainable. Thus, up to the target, the projectile has the perfect ballistic trajectory of a solid projectile or the like and, at the target, the known advantages of shot ammunition are available. The shot ammunition used can be detected by means of its coding in the aforementioned manner. Apart from shot ammunition, it is naturally also possible to use finned ammunition, bursting ammunition or the like. If battery 10 fails, it is possible to use normal shot ammunition for infantry purposes at close range. The arrangement is also such that upon release of the trigger from the second stage into the first stage the values stored in the electronic control unit 16, which can e.g. carry a microprocessor or the like, are erased. That is, the range values can be erased whether there has been a release of the shot or the marksman, without releasing a shot, has taken a bearing on a new target whose range values and the like are once again to be decisive for the planned shot. In a conventional manner, barrel 22 can be smooth, rifled or slotted. Magazine 20 can be in drum or bar form. It is also possible to use convention mechanical, electrical and electronic components in the small arm, which can be employed for hunting as well as infantry purposes.

As a result of the lack of special safety means, the shot ammunition embodiment of FIG. 2 is only capable of use for hunting purposes and certain infantry purposes without this leading to any danger for the marksman. This is due to the ammunition having an explosive charge which acts as a additional propelling charge, if the propelling charge igniter fails and, consequently, the explosive charge detonates within the weapon barrel 22 accompanied by the simultaneous ignition of the propelling charge 24. The ammunition embodiment of FIGS. 3 to 6 also permits the use of highly explosive charges 26 or projectile heads, thereby providing heavy metal pellets or the like for attacking e.g. harder or hardened targets. For this purpose, the explosive charge igniter 30 of the ammunition is provided in known manner with a propelling charge cartridge 32 and a projectile head 34 detachably connected thereto and has a central primer 36, subject to the action to a central firing pin 38. A fast-burning priming composition 40 is arranged in a protective sleeve 42 concentrically to the longitudinal axis of the projectile within the propelling charge cartridge 32, in addition to a delayed action composition 44 and a T-shaped explosive priming composition 46 in the case of the embodiments of FIGS. 3, 5 and 6. Concentrically to the primer 36 is arranged the propelling charge igniter 28 in the form of a ring igniter subject to the action of an ignition ring 48. The delayed action composition 44 and the explosive priming composition 46 are located within a fuse 50. The fuse 50 is provided with two opposite ignition bores 52 close to its end facing the projectile head tip. The ignition bores 52 are filled in the case of the embodiment of FIGS. 3, 5 and 6 in T-shaped manner with the material of the explosive priming composition 46, whilst the explosive priming composition 46, in the case of the embodiment of FIG. 4, is located exclusively within the bore of the fuse 50, so that the ignition bores 52 remain free thereof. Fuse 50 is positioned in longitudinally displaceable manner, concentric to the projectile axis within an ignition sleeve 54. Ignition sleeve 54 also has two facing wall bores 56 which are so displaced with respect to the ignition bores 52 that on igniting the explosive priming composition 46, the explosive charge 26 cannot be detonated, in the operating state according to FIG. 3, in which the projectile head 34 is connected to the propelling charge cartridge 32. As shown in FIG. 3, a compression spring 58 in the ignition sleeve 54 presses the end of the fuse 50 remote from the projectile tip into a position in which the ignition bores 52 and wall bores 56 are not aligned. In this position, fuse 50 engages the protective sleeve 42 of the fast-burning priming composition 40. Ignition sleeve 54 is provided with a widened portion 60 facing the propelling charge 24. In known manner, the explosive charge 26 is surrounded by a plurality of shot pellets 62, optionally in the form of heavy metal pellets for attacking harder or hardened targets and the like.

In the embodiment of FIGS. 3 to 6, the shot ammunition according to the invention functions in the following way. In normal operation, the central firing pin 38 strikes the primer 36 of the explosive charge igniter 30, whereupon the fast-burning priming composition 40 burns off and ignites the delayed action composition 44 in the fuse 50, which burns for a predetermined time. With a time lag with respect to the central firing pin 38 selected according to the invention, the ignition ring 48 actuates the ring igniter of the propelling charge igniter 28, which in turn brings about the burning off of propelling charge 24. Thus, the projectile head 34 is detached from the propelling charge cartridge 32 and leaves the small-arm barrel. The support of the fuse 50 on the propelling charge cartridge 32 or on the end region of the protective sleeve 42 for the fast-burning priming composition 40 is removed by the release of the projectile head 34 from the cartridge 32. Thus, the compression spring 58 move the fuse 50 within the ignition sleeve 54 in such a way that the ignition bores 52 of fuse 50 are brought into alignment with the wall bores 56 of sleeve 54. In this reciprocal relative position of fuse 50 and ignition sleeve 54 and which is shown in FIG. 4, the burning delayed action composition 44 reaches the explosive priming composition 46 and ignites the latter. In the manner indicated by corresponding lightning or danger arrows in FIG. 4, composition 46 detonates the explosive charge 26 at the fixed time following the leaving of the small-arm barrel 22, while in FIG. 3 corresponding arrows indicate the ignition of propelling charge 24 by propelling charge igniter 28.

However, if for some reason propelling charge 24 does not ignite, then the operating stage shown in FIG. 5 is obtained. That is, the projectile head 34, which is still connected to the propelling charge cartridge 32, is still in the small-arm barrel 22. The explosive priming composition 46 then burns off in an unused manner, because as a result of the displaced arrangement of the ignition bores 52 of fuse 50 and the wall bores of ignition sleeve 54 there can be no action on explosive charge 26. However, if for some reason the ignition process for the fastburning priming composition 40 of the explosive charge igniter 30 fails, then in the manner indicated to the right in FIG. 6 by the lightning or danger arrows, the burning off propelling charge 24 ignites the delayed action composition 44, so that the explosive charge 26 is detonated with the maximum time lag after leaving the small-arm barrel. It is pointed out that the gas pressure produced by the burning off of propelling charge 24 is in all cases greater than the mass moment of inertia of fuse 50 during acceleration, together with the restoring force of spring 58.

The aforementioned embodiment of the shot ammunition usable according to the invention ensures maximum safety for the small-arm and marksman even when using highly explosive charges 26 or a corresponding construction of the projectile head 34, such as is e.g. the case when attacking harder targets. A detonation of explosive charge 26 in the barrel or before reaching the desired detonation time is avoided in all circumstances. Without being shown in the drawings, the electrical supply unit according to the invention can have a generator means for converting at least part of the mechanical energy applied in operating the trigger unit 18 into electrical energy. The amount of electrical energy obtained is at least sufficient to ensure the supply of the ignition means for the propelling charge and explosive charge during firing. Preferably, the complete electrical supply unit 10 is so designed or constructed that a corresponding, e.g. inductive or piezoelectric, generator means can be used to obtain sufficient electrical energy on operating trigger unit 18 to cover all the electrical supply requirements of the small-arm, whilst at least helping to make good the quantities of electrical energy consumed. Apart from an accumulator or the like chargeable by operating the trigger unit 18 in the aforementioned manner, the electrical supply unit can e.g. also contain a mechanical gyrating mass.

We claim:

1. Shot ammunition for use in a small-arm device, said shot ammunition comprising:

a propelling charge having a propelling charge igniter and an explosive charge having an explosive charge igniter, so that the detonation time of said explosive charge has a fixed time lag and the detonation time of said propelling charge has a variable time lag, wherein said explosive charge is only detonated after said propelling charge has burnt off and wherein said explosive charge igniter comprises a primer with a following fast-burning primer composition, a following delayed action composition, and an explosive primer composition, wherein the delayed action composition and the explosive primer composition are received in a fuse arranged in a projectile head having the explosive charge and parallel to the longitudinal axis of the projectile, said fuse being positioned in a longitudinally displaceable manner in an ignition sleeve surrounded by the explosive charge and having one end pressed against a propelling charge cartridge by a spring, the fuse in the vicinity of the explosive primer composition and the ignition sleeve each having at least one bore which are displaced with respect to one another while the projecting head and propelling cartridge remain connected and are brought into alignment with one another when the projectile head is detached from the propelling charge cartridge as a result of the longitudinal displacement of the fuse in the ignition sleeve and under the action of the spring.

2. Shot ammunition according to claim 1, wherein the fixed time lag of the detonation time of the explosive charge igniter corresponds to a firing range of approximately 500 m with respect to the operation thereof.

3. Shot ammunition according to claim 1, wherein the propelling charge igniter or the explosive charge igniter is electrically or electronically operated.

4. Shot ammunition according to claim 1, wherein the propelling charge igniter or the explosive charge igniter is operated mechanically.

5. Shot ammunition according to claim 1, wherein the propelling charge igniter is constructed as a ring igniter and the explosive charge igniter as a central igniter.

6. Shot ammunition according to claim 1, wherein the explosive charge igniter is positioned laterally on the explosive charge.

7. Shot ammunition according to claim 1, wherein the delayed action composition is ignited by the propelling charge in the case of a failure of the primer or the fast-burning primer composition.

8. Shot ammunition according to claim 1, wherein the ignition sleeve and fuse are in each case closed by a base at their end remote from the propelling charge cartridge and that the spring is a compression spring supported between the base of the fuse and the base of the ignition sleeve.

9. Shot ammunition according to claim 1, wherein the fastburning burning primer composition extends concentrically to the projectile axis substantially from the primer to a contact face of the propelling charge cartridge facing the projectile head and is located within a protective sleeve, which is substantially completely surrounded by the propelling charge, while the ignition sleeve is concentric to the projectile axis.

10. Shot ammunition according to claim 9 wherein the fuse or ignition sleeve is provided at its end facing the propelling charge cartridge with a widened portion for exposing the delayed action composition to the action of the gases of propelling charge.

* * * * *